US006879102B2

(12) United States Patent
Behr et al.

(10) Patent No.: US 6,879,102 B2
(45) Date of Patent: Apr. 12, 2005

(54) INCANDESCENT LAMP FOR MOTOR VEHICLE HEADLIGHTS

(75) Inventors: Gerhard Behr, Altheim (DE); Manfred Bühler, Herbrechtingen (DE); Christian Seichter, Herbrechtingen (DE); Klaus Wittmann, Sontheim (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 163 days.

(21) Appl. No.: 10/426,652

(22) Filed: May 1, 2003

(65) Prior Publication Data

US 2003/0205972 A1 Nov. 6, 2003

(30) Foreign Application Priority Data

May 2, 2002 (DE) ..... 102 19 729

(51) Int. Cl.[7] ..... H01K 9/00
(52) U.S. Cl. ..... 313/578; 313/579; 313/580
(58) Field of Search ..... 313/578–580, 313/315–316, 271–272, 276, 279, 574

(56) References Cited

U.S. PATENT DOCUMENTS

| | | | | | |
|---|---|---|---|---|---|
| 3,774,064 | A | * | 11/1973 | Vause | 313/316 |
| 4,492,893 | A | * | 1/1985 | Steiner et al. | 313/318.07 |
| 4,686,410 | A | * | 8/1987 | Jacrot | 313/113 |
| 4,801,845 | A | * | 1/1989 | Kiesel | 313/579 |
| 5,734,227 | A | * | 3/1998 | Gotoh | 313/578 |
| 5,808,399 | A | * | 9/1998 | Yoneyama | 313/271 |
| 5,850,124 | A | * | 12/1998 | Hasegawa et al. | 313/578 |
| 5,856,723 | A | * | 1/1999 | Rittner | 313/117 |
| 5,949,181 | A | * | 9/1999 | Tabata et al. | 313/271 |
| 5,984,751 | A | | 11/1999 | Rittner | |
| 6,611,101 | B1 | * | 8/2003 | Mitobe et al. | 313/635 |
| 6,709,130 | B2 | * | 3/2004 | Behr et al. | 362/214 |

* cited by examiner

*Primary Examiner*—Ashok Patel
*Assistant Examiner*—Dalei Dong
(74) *Attorney, Agent, or Firm*—William E. Meyer

(57) ABSTRACT

The invention relates to an incandescent lamp for motor vehicle headlights, having at least one incandescent filament (2) arranged inside the lamp vessel, and a shading device (4). A coil exit (2*a*) of the incandescent filament (2) is joined to an edge section (41) of the shading device (4) running substantially parallel to the coil axis, in order to ensure an improved suspension of the incandescent filament (2).

7 Claims, 4 Drawing Sheets

INCANDESCENT LAMP FOR MOTOR VEHICLE HEADLIGHTS

I. TECHNICAL FIELD

Figure 1:
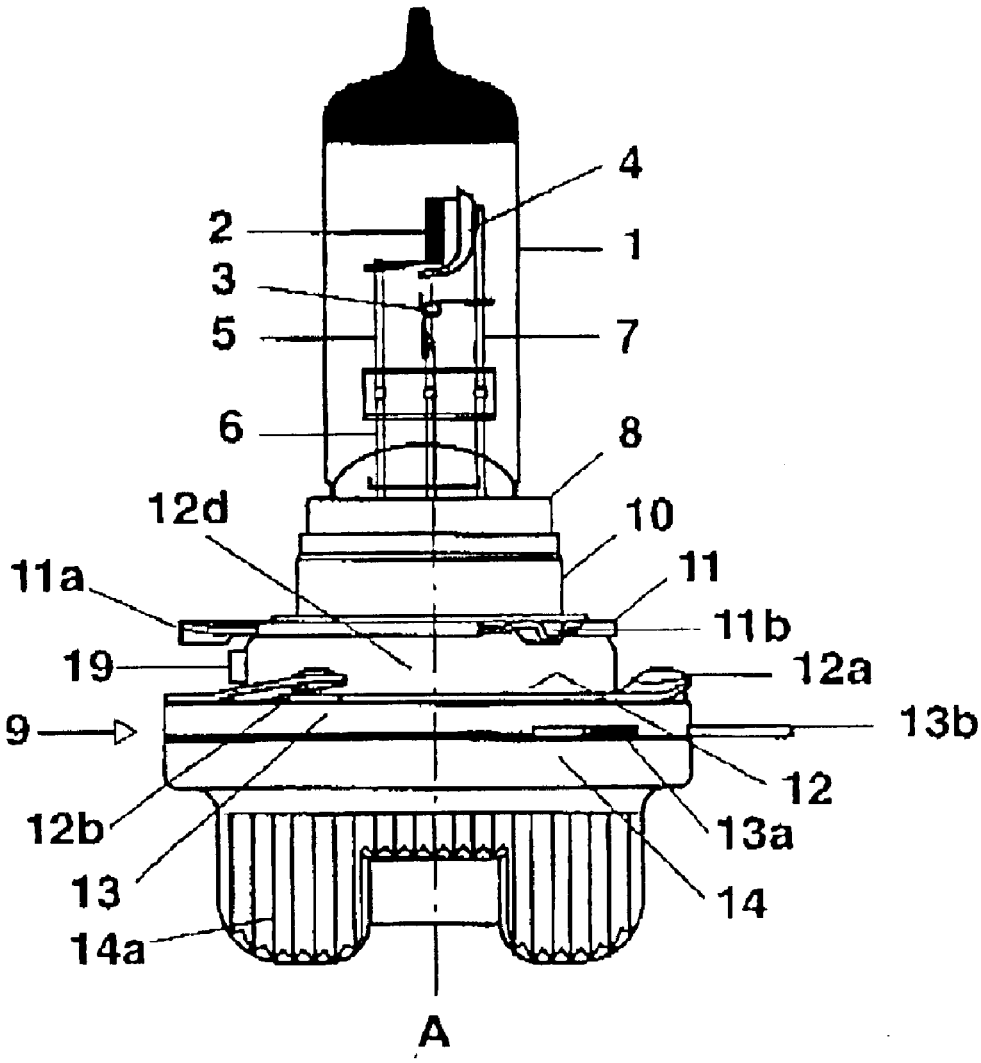

The invention relates to an incandescent lamp for motor vehicle headlights that has a lamp vessel and at least one incandescent filament arranged therein, as well as a shading device arranged inside the lamp vessel, the shading device having an edge with at least one edge section running substantially parallel to the coil axis of the at least one incandescent filament, and the at least one incandescent filament having a coil exit that is joined to the shading device.

II. BACKGROUND ART

Such an incandescent lamp is disclosed, for example, in the international patent application with the publication number WO 98/38670. This laid-open application describes an incandescent lamp with a secondary filament for generating the lower beam, and a primary filament for generating the upper beam in a motor vehicle headlight. Furthermore, the incandescent lamp has a shading device that is arranged in the lamp vessel and shields a portion of the light generated by the secondary filament, and is used to generate the light/dark boundary of the lower beam. A coil exit of the secondary filament is designed as an end that is angled off parallel to the coil axis and is welded to the shading device.

III. DISCLOSURE OF THE INVENTION

It is the object of the invention to provide a generic incandescent lamp with an improved suspension for the incandescent filament joined to the shading device.

This object is achieved according to the invention by an incandescent lamp for motor vehicle headlights that has a lamp vessel and at least one incandescent filament arranged therein, as well as a shading device arranged inside the lamp vessel, the shading device having an edge with at least one edge section running substantially parallel to the coil axis of the at least one incandescent filament, and the at least one incandescent filament having a coil exit that is joined to the shading device, wherein the coil exit is joined to the at least one edge section running substantially parallel to the coil axis of the at least one incandescent filament. Particularly advantageous designs of the invention are described in the dependent patent claims.

The incandescent lamp according to the invention for motor vehicle headlights has a lamp vessel and at least one incandescent filament arranged therein, as well as a shading device arranged inside the lamp vessel, the shading device having an edge with at least one edge section running substantially parallel to the coil axis of the at least one incandescent filament, and the at least one incandescent filament having a coil exit that is joined to this edge section of the shading device. This arrangement of the coil exit ensures that the coil exit need not be angled off to be joined to the shading device. The production and the mounting of the incandescent filament are thereby simplified.

In order to ensure as simple as possible a joint between the coil exit and the shading device, the shading device is advantageously fitted with a lug that is integrally formed on the at least one edge section running substantially parallel to the coil axis of the at least one incandescent filament, and that extends transverse to this edge section. This lug is excellently suited for producing a welded joint with the coil exit. In order further to improve the welded joint, the coil exit is advantageously sheathed with a metal foil. It permits the at least one incandescent filament to be fastened to the shading device without in the process causing an undesired torsion or deformation of the incandescent filament and prevents an embrittlement of the coil exit upon welding to the shading device. The metal foil preferably consists of a high-melting metal such as, for example, molybdenum, tantalum, tungsten or an alloy of the aforementioned metals, in order to withstand the high temperature during operation of the lamp, and in order to ensure a good joint with the shading device consisting of molybdenum or of a molybdenum alloy.

The two coil exits of the at least one incandescent filament are advantageously arranged in such a way that the sections of the coil exits shining during operation of the lamp—which are those sections of the coil exits that directly adjoin the first or last turn of the part of the incandescent filament serving to generate light—belong to the region of the incandescent filament surface averted from the shading device. That is to say, in particular, that these shining sections of the coil exits do not belong to the region of the incandescent filament surface facing the shading device and whose projection or whose image is used to generate the light/dark boundary. Consequently, neither the coil exits themselves nor their mirror images generated by the lamp vessel disturb the formation of a sharp light/dark boundary in the headlight.

Moreover, the two coil exits of the at least one incandescent filament advantageously form an angle of between 90 degrees and 130 degrees in a plane perpendicular to the coil axis. The mechanical stresses in the at least one incandescent filament can be minimized by means of this measure.

IV. BRIEF DESCRIPTION OF THE DRAWINGS

Figure 2:
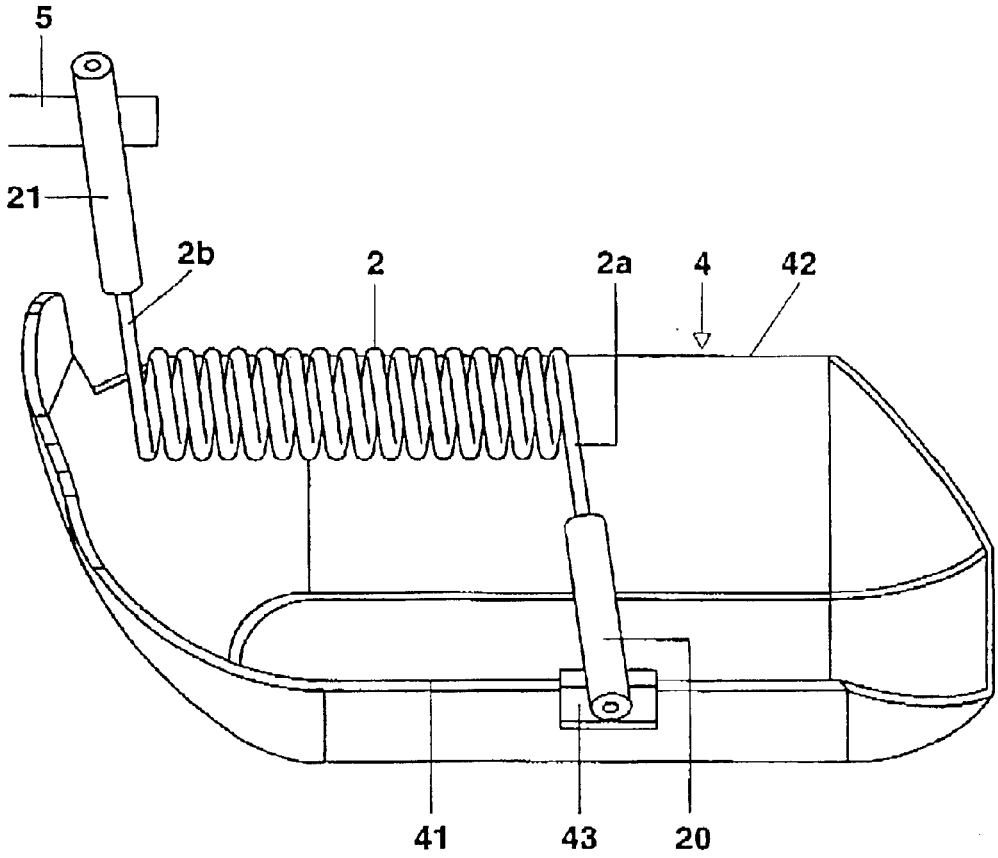
Figure 3:
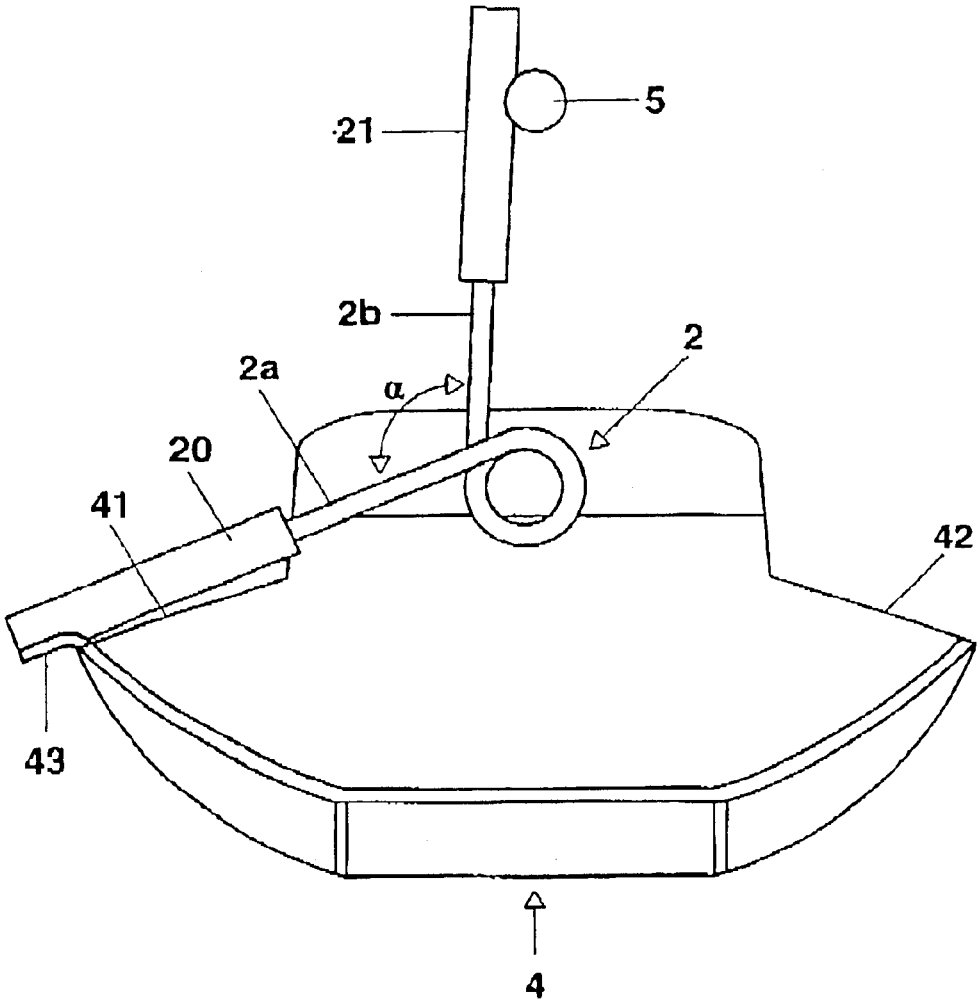
Figure 4:
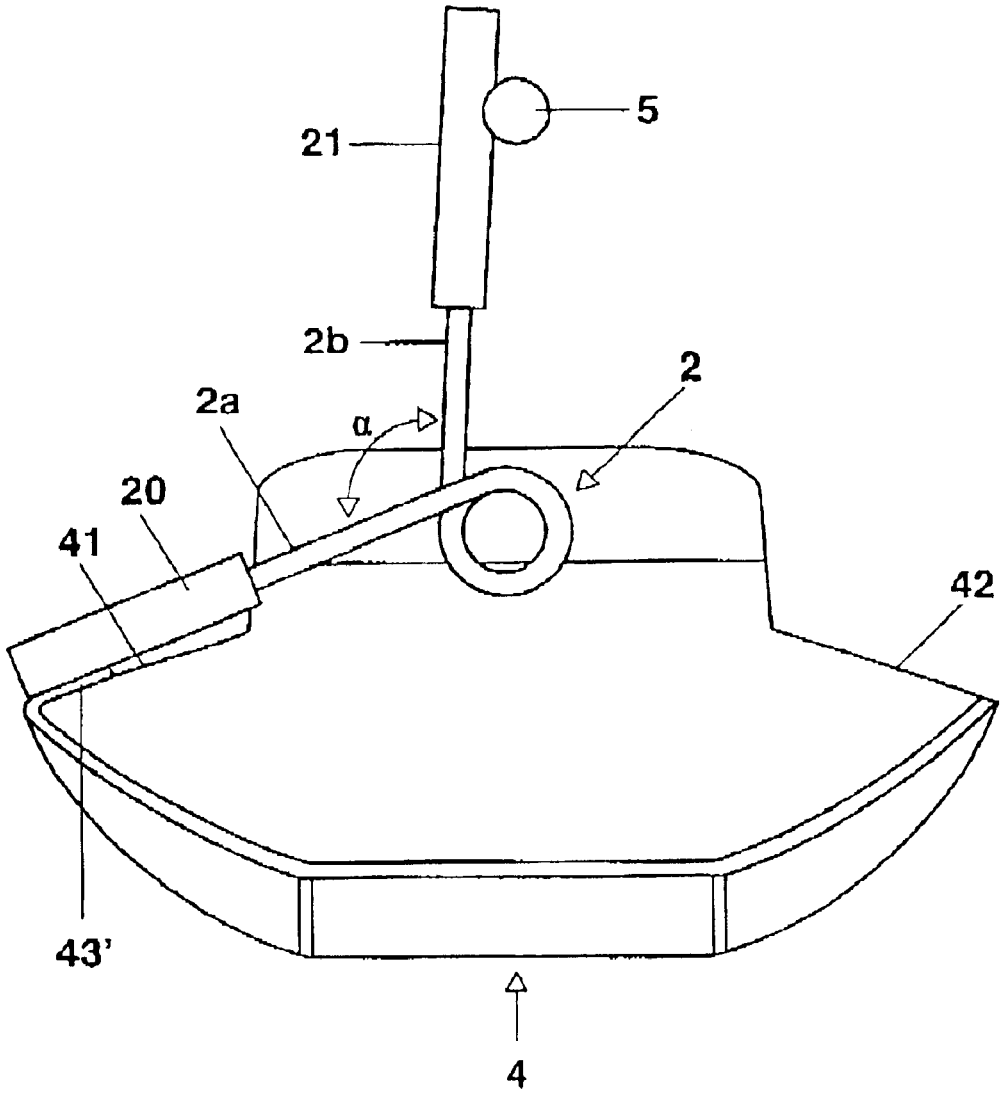

The invention is explained in more detail below with the aid of a preferred exemplary embodiment. In the drawing:

FIG. 1 shows a side view of an incandescent lamp in accordance with the preferred exemplary embodiment of the invention, in a schematic, FIG. 2 shows a plan view of the secondary filament, and the shading device of the incandescent lamp depicted in FIG. 1, FIG. 3 shows a plan view of the secondary filament, and the shading device in an illustration rotated by 90 degrees relative to that in FIG. 2, and FIG. 4 shows a exemplary embodiment of the invention, in which the free end of the lug extends in the direction of the secondary filament.

V. BEST MODE FOR CARRYING OUT THE INVENTION

The preferred exemplary embodiment, illustrated in FIG. 1, of the invention is a two-filament halogen incandescent lamp which is intended for insertion into a motor vehicle headlight. This lamp has a vitreous, essentially cylindrical lamp vessel 1, inside which there are enclosed two incandescent filaments 2, 3, of which one is arranged axially and the other transverse to the longitudinal axis A of the lamp base. The axially aligned incandescent filament 2 is surrounded in part by a shading device 4, likewise arranged inside the lamp vessel 1. Three supply leads 5, 6 and 7, which are led out of the end of the lamp vessel 1 near the base, serve to hold and supply voltage to the incandescent filaments 2, 3 and the shading device 4. The end of the lamp vessel 1 near the base is anchored with a clamping fit in a cutout in a metallic holder 8 which is, for its part, a component of the lamp base 9. The metallic holder 8 is fixed in the metallic adjusting ring 10 which is welded to the reference ring 11. The reference ring 11 has three reference noses 11*a,* 11*b* (only two reference noses are visible in the drawings) which extend radially outward substantially perpendicular to the longitudinal axis A and lie in a common plane. The reference ring 11 is welded to the metallic, annular base flange 12, whose flange plane is arranged substantially perpendicular to the longitudinal axis A. The base flange 12 has three resiliently designed lugs 12*a,* 12*b* (only two lugs are visible in the drawings) which are arranged uniformly along its annular circumference and develop a spring action in the longitudinal direction A of the lamp. The reference noses 11*a,* 11*b* serve as opposing bearings to the resilient lugs. The reference noses 11*a,* 11*b* form a bayonet lock together with the base flange 12 and its lugs 12*a,* 12*b,* as well as with the opening, correspondingly configured as a lamp holder, of the headlight reflector. Serving to provide lateral support for the lamp at the rim of the headlight reflector opening is a press-on spring 19 which projects outward through a cutout in the annular collar 12*d* of the base flange 12.

Adjoining the base flange 12 is the plastic ring 13, from which there project three metallic contact lugs 13*a,* 13*b* (only two contact lugs are visible in the drawings), which are connected in each case in an electrically conducting fashion to a supply lead 5, 6, 7 and form the electric contacts of the headlight lamp. The three contact lugs 13*a,* 13*b* and, in particular, also their contact surfaces are arranged in a common plane perpendicular to the axis of the plastic ring 13, and thus also substantially perpendicular to the longitudinal axis A. The end, averted from the lamp vessel 1, of the lamp base 9 is formed by the grip part 14, which consists of plastic and is fixed by an undetachable plug-in connection on the plastic ring 13 and on the base flange 12. The grip part 14 has a web 14*a* running perpendicular to the longitudinal axis A along a diameter of the plastic ring 13. The web 14*a* can serve as a grip for locking and unlocking the bayonet lock when changing the lamp.

FIGS. 2 and 3 show details of the shading device 4 and of the incandescent filament 2 used to generate the lower beam. This incandescent filament 2, which is also designated as secondary filament 2, has a first coil exit 2*a,* which is joined to the shading device 4, and a second coil exit 2*b,* which is joined to the supply lead wire 5. The two coil exits 2*a,* 2*b* are each sheathed with a clamping fit by a molybdenum foil 20, 21, which serves as welding aid for joining the coil exits 2*a* and 2*b* to the shading device 4 or to the supply lead 5. The shading device 4 has two mutually opposite edge sections 41, 42, which run substantially parallel to the coil axis of the secondary filament 2. The shading device 4 is provided with a lug 43 that is integrally formed on the edge section 41 and extends outward transverse to this edge section 41 such that the free end of the lug 43 is directed away from the secondary filament 2. Moreover, the lug 43 is angled off from the edge section 41. The coil exit 2*a* sheathed by the molybdenum foil 20 is welded to the lug 43. The two coil exits 2*a,* 2*b* form an angle $\alpha$ of 115 degrees with one another in a plane perpendicular to the coil axis of the secondary filament 2.

The invention is not limited to the exemplary embodiment explained above in more detail. For example, the free end of the lug 43 can also point in the direction of the secondary filament 2. As depicted in FIGS. 2 and 3, the coil exits 2*a,* 2*b* can be designed as uncoiled ends of the secondary filament 2 or, alternatively, also be designed as coiled ends of the secondary filament 2. In the case of a singly coiled incandescent filament 2, the coil exits 2*a,* 2*b* are uncoiled, and in the case of a doubly coiled incandescent filament 2, the coil exits 2*a,* 2*b* are singly coiled. However, this is unimportant for the welded joint between the secondary filament 2 and the shading device 4 or the supply lead 5, since the molybdenum foils 20, 21 render good weldability possible for both types of coil exits.

FIG. 4 shows a second exemplary embodiment of the invention, in which the free end of the lug 43' extends in the direction of the secondary filament 2, and thus points in the opposite direction compared with the lug 43 in the first exemplary embodiment. In all other details, the second exemplary embodiment corresponds to the first. In particular, the lug 43' is integrally formed on the edge section 41 and the coil exit 2*a,* around which the molybdenum foil 20 is wound, is welded to the lug 43'. Consequently, the same reference numerals have been used for identical parts in FIGS. 3 and 4.

Furthermore, it is also possible for the coil exit 2*a* to be fastened on the shading device by means of a hook-shaped or U-shaped lug (not depicted) that is integrally formed on the shading device 4 and has a gap for holding the coil exit 2*a,* the gap width being dimensioned such that the coil exit 2*a* is arranged with a clamping fit in the gap. In addition, the coil exit 2*a* can be joined to the lug by a weld in order to achieve as little contact resistance as possible between the coil exit 2*a* and the lug. Moreover, the U limbs of the lug can be joined to one another by a weld in order to ensure a lasting clamping fit of the coil exit 2*a* in the gap. It is also possible, if appropriate, to dispense with sheathing the coil exit 2*a* with a molybdenum foil 20 in this type of joint.

What is claimed is:

1. An incandescent lamp for motor vehicle headlights comprising: a lamp vessel and at least one incandescent filament arranged therein, the filament being in the form of an axially extending coil, and a shading device arranged inside the lamp vessel, the shading device having an edge with at least one edge section running offset from and on a side of the coil to substantially parallel the coil axis of the at least one incandescent filament, and the at least one incandescent filament having a coil exit that extends substantially transverse to the coil axis to the at least one edge section, wherein the coil exit is joined to the at least one edge section offset from and on a side of the coil of the at least one incandescent filament.

2. The incandescent lamp as claimed in claim 1, wherein the shading device has a lug that is integrally formed on the at least one edge section running substantially parallel to the coil axis of the at least one incandescent filament, and that extends transverse to this edge section, the coil exit being fastened on the lug by a welded joint.

3. The incandescent lamp as claimed in claim 1, wherein the at least one incandescent filament has a further coil exit, the coil exit forming with the further coil exit in a plane perpendicular to the coil axis of this incandescent filament an angle of between 90 degrees and 130 degrees.

4. The incandescent lamp as claimed in claim 1, wherein the coil exit is sheathed with a metal foil.

5. The incandescent lamp as claimed in claim 4, wherein the metal foil consists of molybdenum, tantalum, tungsten or an alloy of these metals, and the shading device consists of molybdenum or a molybdenum alloy.

6. The incandescent lamp as claimed in claim 1, wherein the at least one incandescent filament has a further coil exit, the coil exits of the at least one incandescent filament being arranged in such a way that their sections shining during operation of the lamp belong to the region of the incandescent filament surface averted from the shading device.

7. The incandescent lamp as claimed in claim 2, wherein the coil exit is sheathed with a metal foil.

* * * * *